United States Patent [19]

Rumbaugh

[11] Patent Number: 4,669,537

[45] Date of Patent: Jun. 2, 1987

[54] WELL TEST TOOL AND SYSTEM

[75] Inventor: William D. Rumbaugh, Carrollton, Tex.

[73] Assignee: Otis Engineering Corporation, Dallas, Tex.

[21] Appl. No.: 907,988

[22] Filed: Sep. 16, 1986

[51] Int. Cl.[4] ..... E21B 34/14; E21B 43/12; E21B 47/06; E21B 49/08

[52] U.S. Cl. ..... 166/113; 166/264; 166/332; 166/373; 166/385; 166/386

[58] Field of Search ..... 166/332, 113, 264, 250, 166/373, 385, 386, 317, 142, 152

[56] References Cited

U.S. PATENT DOCUMENTS

| | | | |
|---|---|---|---|
| Re. 31,313 | 7/1983 | Fredd et al. | 166/250 |
| 2,698,056 | 12/1954 | Marshall et al. | 166/123 |
| 2,920,704 | 1/1960 | Fredd | 166/125 |
| 3,208,531 | 9/1965 | Tamplen | 166/125 |
| 4,051,897 | 10/1977 | Kingelin | 166/125 |
| 4,134,452 | 1/1979 | Kingelin | 166/133 |
| 4,149,593 | 4/1979 | Gazda et al. | 166/113 |
| 4,159,643 | 7/1979 | Watkins | 73/155 |
| 4,274,485 | 6/1981 | Fredd | 166/250 |
| 4,286,661 | 9/1981 | Gazda | 166/316 |
| 4,373,583 | 2/1983 | Waters | 166/113 |
| 4,487,261 | 12/1984 | Gazda | 166/264 |
| 4,583,592 | 4/1986 | Gazda et al. | 166/250 |

OTHER PUBLICATIONS

The brochure entitled "MUST" published by Flopetrol Johnston covering the MUST Universal DST Real Time Surface Pressure Readout.

*World Oil* magazine, Oct. 1983, p. 21.

*Composite Catalog of Oil Field Equipment and Services,* 34th Revision, 1980–1981 edition, vol. 4, published by World Oil magazine, p. 5972.

*Primary Examiner*—Stephen J. Novosad

*Attorney, Agent, or Firm*—Albert W. Carroll

[57] ABSTRACT

A test tool including a locking device and a sleeve valve with a recording instrument attached, for use in testing wells as for the purpose of gathering data for reservoir evaluation, the test tool is installed in a landing receptacle in a well and, preferably near the reservoir to be evaluated, the test tool being run into the well on a conventional wireline tool string and an operating tool and locked and sealed in the landing nipple. The sleeve valve of the test tool is left open during running and is generally left open for a period during which the well is flowed, after which the valve is then closed by a pull on the wire line attached to the operating tool and left closed to allow pressure to build up below the test tool. Slacking the wire line causes the test tool to open. The test tool can be cycled between open and closed positions as many times as desired. When the last cycle has been performed, the valve is closed and the operating tool is retrieved from the well. A second trip with the wireline tools is necessary to retrieve the test tool. Well test systems utilizing such test tools are also disclosed. After retrieving the test tool from the well, the recorded data are obtained from the instrument. A reverse acting valve for the test tool is also disclosed.

20 Claims, 27 Drawing Figures

WELL TEST TOOL AND SYSTEM

BACKGROUND OF THE INVENTION

1. Field of the Invention

This invention relates to flow testing of existing wells and more particularly to test tools which are run on a flexible line and are operable thereby from the surface to shut in a well and to open it up at a subsurface depth, preferably at a location just above the formation being tested, the test tool being installed in a landing nipple at or near the producing formation to be tested.

2. Description of the Prior Art

Until a few years ago, downhole well data were generally obtained by lowering a bottom hole pressure gage into a well on a wire line after the well had been closed in at the surface for maybe 48 to 72 hours. The gage usually carried a maximum-recording thermometer. The gage was lowered to a location a predetermined distance below sea level, usually at or near the casing perforations. The gage was normally suspended at this depth for a few minutes while the well remained shut-in to record the formation pressure and temperature. The well was then placed on production at a predetermined rate of flow to obtain recordings of the draw-down characteristics of the well. The data thus obtained were then evaluated by reservoir technicians to aid them in their effort to determine more accurately the extent, shape, volume, and contents of the reservoir.

Since the well was controlled by valves located at the surface, usually a great distance from the reservoir, problems arose as a result of the reaction of the column of production fluids in the well tubing. During shut-in periods, liquids would settle to bottom and the gas would collect thereabove, introducing uncertainties into the data obtained and clouding the formation's characteristics. It became desirable to have the ability to open and close the well at a point as near the perforations as possible and thus avoid the need to build up and draw down the great volume and height represented by the well bore or well tubing extending many thousands of feet from the reservoir to the surface. Further it was desirable to run a test tool including sensor means on a conductor cable and be able to control the downhole opening and closing means from the surface while recording and displaying at the surface, and in real time, the downhole data as they were sensed by the test tool.

The Applicant is familiar with the following prior patents which may have some bearing upon the well testing problems as relates to the present invention.

| | | |
|---|---|---|
| Re.31,313 | 4,051,897 | 4,286,661 |
| 2,673,614 | 4,134,452 | 4,373,583 |
| 2,698,056 | 4,149,593 | 4,487,261 |
| 2,920,704 | 4,159,643 | 4,583,592 |
| 3,208,531 | 4,274,485 | |

Also, Applicant is familiar with a brochure published by Flopetrol-Johnston covering their MUST Universal DST device.

Applicant is further familiar with an editorial comment published in WORLD OIL magazine, page 21, Oct. 1983 Edition.

In addition, they are familiar with the landing nipples illustrated on page 5972 of the Composite Catalog of Oil Field Equipment and Services, 1980–81 Edition, published by WORLD OIL magazine.

U.S. Pat. No. 4,134,452 issued to George F. Kingelin on Jan. 16, 1979; U.S. Pat. No. 4,149,593 issued to Imre I. Gazda, et al, on Apr. 17, 1979; U.S. Pat. No. 4,159,643 issued to Fred E. Watkins on July 3, 1979; U.S. Pat. No. 4,286,661 issued on Sept. 1, 1981 to Imre I. Gazda; U.S. Pat. No. 4,487,261 issued to Imre I. Gazda on Dec. 11, 1984; U.S. Pat. No. 4,583,592 issued to Imre I. Gazda and Phillip S. Sizer on Apr. 22, 1986; and U.S. Pat. Re. No. 31,313 issued July 19, 1983 to John V. Fredd and Phillip S. Sizer, on reissue of their original U.S, Pat. No. 4,274,485 which issued on June 23, 1981, all disclose test tools which may be run on a wire line or cable and used to open and close a well at a downhole location by pulling up or slacking off on the wire line or cable by which these test tools are lowered into the well. In most of the above cases, a receptacle device is first run on a wire line and anchored in a landing nipple, then a probe-like device is run and latched into the receptacle. In the other cases, the receptacle is run in with the well tubing.

U.S. Pat. No. 4,134,452 provides only a tiny flow passage therethrough openable and closable by tensioning and relaxing the conductor cable for equalizing pressures across the tool.

U.S. Pat. No. 4,149,593 is an improvement over the device of U.S. Pat. No. 4,134,452 and provides a much greater flow capacity as well as a locking sub which locks the tool in the receptacle with a tenacity somewhat proportional to the differential pressure acting thereacross.

U.S. Pat. No. 4,286,661 is a division of U.S. Pat. No. 4,149,593, just discussed, and discloses an equalizing valve for equalizing pressures across the device disclosed in U.S. Pat. No. 4,149,593.

U.S. Pat. No. 4,159,643 discloses a device similar to those mentioned above and has a relatively small flow capacity. This tool has lateral inlet ports which are closed by tensioning the conductor cable.

U.S. Pat. No. 4,373,583 discloses a test tool similar to those just discussed. It carries a self-contained recording pressure gage suspended from its lower end and therefore sends no well data to the surface during the testing of a well. This tool, therefore, may be run on a conventional wire line rather than a conductor line, since it requires no electrical energy for its operation. The present invention is an improvement over the invention of U.S. Pat. No. 4,373,583.

U.S. Pat. Re. No. 31,313 discloses a device similar to that of U.S. Pat. No. 4,373,583 in that it has lateral inlet ports which are opened and closed by moving a probe up or down through tensioning or relaxing the wire line or cable on which it is lowered into the well.

The MUST Drill Stem Test Tool of Flopetrol-Johnston disclosed in the brochure mentioned above and in the article published in WORLD OIL magazine provides a non-retrievable valve opened and closed from the surface by tensioning and relaxing the conductor cable connected to the probe-like tool latched into the valve. Even with the valve open and the well producing, no flow takes place through the probe. All flow moves outward through the side of the valve into a bypass passage which then empties back into the tubing at a location near but somewhat below the upper end of the probe. The device provides large or "unrestricted" flow capacity. The probe automatically releases when a predetermined number (up to twelve) of open-close cycles have been performed.

U.S. Pat. No. 2,698,056 which issued to S. J. E. Marshall et al. on Dec. 28, 1954; U.S. Pat. No. 2,920,704 which issued to John V. Fredd on Jan. 12, 1960; U.S. Pat. No. 2,673,614 issued to A. A. Miller on Mar. 30, 1954; and U.S. Pat. No. 3,208,531 issued to J. W. Tamplen on Sept. 28, 1965; disclose various devices for locking well tools in a well flow conductor.

U.S. Pat. No. 2,673,614 shows keys having one abrupt shoulder engageable with a corresponding abrupt shoulder in a well for locating or stopping a locking device in a well at the desired location in a landing receptacle for its locking dogs to be expanded into a lock recess of that receptacle. A selective system is disclosed wherein a series of similar but slightly different receptacles are placed in a tubing string. A locking device is then provided with a selected set of locator keys to cause the device to stop at a preselected receptacle.

U.S. Pat. No. 3,208,531 discloses a locking device which uses keys profiled similarly to the keys of U.S. Pat. No. 2,673,614 but performing both locating and locking functions.

The present invention is an improvement over that disclosed in U.S. Pat. No. 4,373,583 and overcomes some of the problems encountered in test tools which are for use in existing wells in that it requires but two trips into the well—one trip to install the test tool and to perform the tests, and a second trip to retrieve the test tool. Also, the sleeve valve is easier to move between open and closed positions since pressures acting thereon are balanced. Further, the test tool has high flow capacity and can be cycled between open and closed positions any number of times with little or no jarring.

SUMMARY OF THE INVENTION

The present invention is directed to well test tools and systems utilizing landing receptacles in existing wells, the test tool including a locking mandrel having lock means and seal means thereon for locking and sealing the lock mandrel in the receptacle, the lock mandrel having a valve thereon including a housing with means at its lower end for attachment of a recording instrument and having lateral ports and a sleeve valve member therein movable between upper and lower positions to open and close said ports, and an operating tool for installing and operating said lock mandrel and valve, the operating tool including an operating tube extending through the lock mandrel and having a releasable connection with the sleeve valve for moving the same between open and closed positions for providing alternate flow and shut-in periods as desired by lifting and lowering the operating tool by manipulation of the conventional wire line on which the test tool is lowered into the well.

It is therefore one object of this invention to provide a test tool for use in combination with a recording instrument in testing existing wells having a landing receptacle connected in the well tubing and forming a part thereof.

Another object is to provide such a well test tool which can be used to shut in or open the well at a location near the producing formation and can be opened and closed any number of times to perform the type of tests desired, the attached instrument recording changes in at least one parameter in the well.

Another object is to provide such a test tool which is run into the well on a conventional wire line and operating tool, installed in a landing nipple and, when actuated to closed position, automatically disconnects the operating tool for withdrawal from the well, but after such disconnect, the operating tool can still be re-inserted into the test tool for further cycling, even though the operating tool will be disconnected therefrom each time that the test tool is moved to closed position.

Another object is to provide such a tool with shearable means to facilitate cycling thereof by maintaining connection of said operating tool to the test tool when the test tool is closed, thus preventing the undesirable disconnection until the last cycle is completed, after which the shearable means may be sheared to disconnect the operating tool for withdrawal from the well.

Another object is to provide a well test tool of the character described having a sleeve valve in which, as the valve is closing, the ports of the sleeve valve and the ports in the housing become misaligned and pinch the fluid flow therethrough to a minimum before the ports of the sleeve valve begin to move past a resilient seal ring to seal the valve in full closed position. In similar manner, as the valve is opening, the ports of the sleeve valve cross the seal ring fully while the fluid flow therethrough is again pinched to a minimum.

Another object is to provide a well test tool of the character just described wherein the pair of seals sealing above and below the ports in the valve housing are disposed in annular recesses provided between axially aligned upper, intermediate, and lower seal tubes, the intermediate seal tube being ported and having a close fit about the sleeve valve for pinching the flow therethrough, these separate seal tubes being replaceable for economical repairs.

Another object of this invention is to provide a test tool which is useful in performing testing operations in a well where the flow of fluids is either from or toward the formation, as in production or injection.

Another object is to provide a well test tool of the character described which requires but two trips into the well—one trip to install the test tool and perform the testing operations, and a second trip to retrieve the test tool.

Another object of this invention is to provide such a well test tool having a pressure-balanced valve which can be operated with minimal force, even under conditions of large pressure differentials, thus avoiding damage to the recording instrument attached thereto.

Other objects and advantages of this invention will become apparent from reading the description which follows and from studying the accompanying drawing wherein:

DESCRIPTION OF THE PREFERRED EMBODIMENTS

Figure 1:
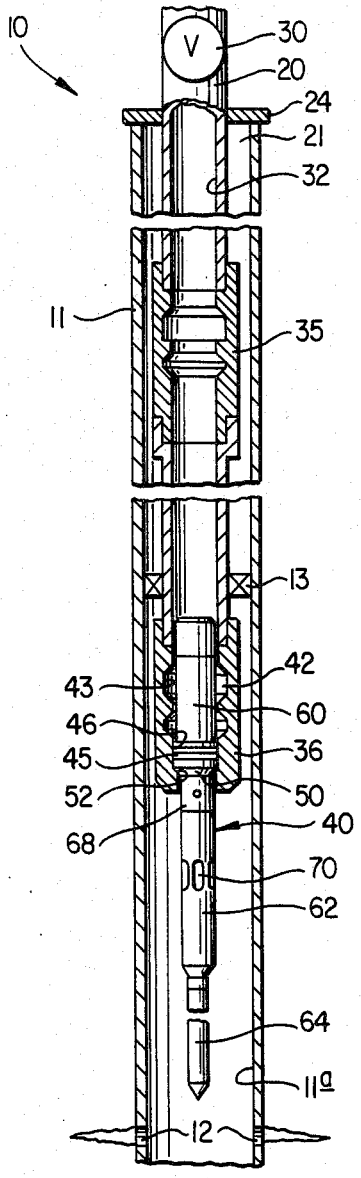
FIG. 1 is a schematical view showing a well with the test tool of the present invention installed therein.

Referring now to FIG. 1, it will be seen that the well, indicated generally by the reference 10, is provided with a well casing 11 which penetrates a subterranean formation such as an oil or gas reservoir (not shown) but at the level of which a plurality of perforations 12 have been made as by a perforating gun in order to permit the flow of fluids from the formation into the casing bore 11*a*. A well tubing 20 is disposed within the casing, and the tubing-casing annulus 21 is closed at the top by suitable means 24 which may be a conventional wellhead, blowout preventers, or the like. At the upper end of the tubing there is provided a valve 30 which may represent a Christmas tree, or the like. Valve 30 controls flow from the well. Ordinarily when the valve 30 is open, production fluids may move from the formation (not shown) through the perforations 12 into the casing bore 11*a* and upwardly through the tubing bore 32 to the surface and pass through the valve 30 into a tank, gathering system, or some suitable disposal means.

The well 10 is shown to be equipped with multiple landing receptacles indicated by the reference numerals 35 and 36. These landing receptacles 35 and 36 may be of any suitable type for the operations to be performed in the well. The type of landing nipple shown at 35 is a representation of the Otis Type X landing nipple, and the landing nipple represented by the numeral 36 is a representation of the Otis Type XN landing nipple. These landing nipples are available from Otis Engineering Corporation, Dallas, Tex. The Otis Type X landing nipple and the Type X running tool are illustrated and described in U.S. Pat. No. 3,208,531 mentioned earlier.

The landing nipples 35 and 36 are intended to receive various well tools such as bottom-hole chokes, regulators, safety valves, standing valves, etc., which might be used during the normal life of the well. However, when it becomes necessary to perform flow tests to evaluate the producing reservoir, it is generally desirable to place the test tool as near the producing formation as is practical. In the well 10 as shown, the Type XN landing nipple 36 is located at the lower end of the well tubing and provides a very suitable receptacle for the well test tool which is represented here by the reference numeral 40.

The test tool 40 having its valve in open position was lowered into the well on a conventional wire line and tool string including the operating tool which is very similar to the Otis Type X running tool and which will be described later. The test tool 40 was landed in the landing nipple 36 with its keys 42 expanded and engaged in the key recesses 43 formed in the landing nipple and with its seal rings 45 sealingly engaged in the seal bore 46. Thus the test tool 40 is locked and sealed in the landing nipple. Further, the downwardly facing no-go shoulder 50 on the test tool engages the upwardly facing no-go shoulder 52 of the landing nipple to positively limit downward movement of the test tool in the landing nipple.

At the time that the test tool was placed in the landing nipple and locked and sealed therein, the valve therein was in open position, and the well was allowed to flow at a selected rate through the test tool, and tubing, and the valve 30 at the upper end thereof so that the pressure in the formation (not shown) would be drawn down to some lower level. At this time, the operating tool and wireline tools were lifted in order to close the valve in the test tool, thus plugging the tubing at the landing nipple. Now, as production fluids continue to enter the well bore through the perforations 12, the pressure in the lower portion of the well would build up to equalize with the producing formation. The region in which buildup occurs is that area which is closed at the uppermost limit by the well packer 13, the tubing of course being plugged by the test tool. The packer may be spaced only a few feet above the perforations so that the region of the well which will be pressurized with the formation will be very small compared to the perhaps thousands of feet of well bore extending thereabove. In this manner, the formation will stabilize in a short time, and the test results will be more meaningful and obtained more quickly.

The test tool 40 as shown in FIG. 1 comprises a lock mandrel 60, a valve 62, and a recording instrument 64. The recording instrument may be any suitable one or type selected from those available. The lock mandrel is selected to be compatible with the receptacle in which it is to be installed. For instance, if the receptacle is a Type X landing nipple, then a Type X lock mandrel is selected.

The valve section 62 is provided at its upper end with an equalizing sub 68 as shown. This equalizing sub 68 is provided with the downwardly facing no-go shoulder 50. If the test tool 40 is placed in a Type X landing nipple, the downwardly facing shoulder 50 will play no part. However, if the test tool 40 is placed in a Type XN landing nipple, which has an upwardly facing no-go shoulder such as the no-go shoulder 52, then the no-go shoulder 50 on the test tool will engage such upwardly facing no-go shoulder to limit downward movement in the landing nipple as before explained. The test tool 40 is provided with lateral inlet ports 70 which, when the sleeve valve (not shown) inside thereof is in open position, will allow flow from the perforations 20, to enter the test tool and pass upwardly through the tubing bore 32 to the surface. Similarly, when the sleeve valve in the valve section is in closed position, flow cannot enter the inlet ports 70 and the well is thus plugged at the landing nipple. Formation pressure then builds up in the lower portion of the well below the packer.

The test tool 40 is run into the well as was stated previously on an operating tool lowered into the well on a wire line and tool string. The operating tool attaches to the test tool in such manner that it can be used to install the lock mandrel in the locking receptacle and thereafter operate the valve inside the test tool. In some cases, the tool is installed and left in the open position while flow tests are performed after which the valve is closed and the operating tool disconnected therefrom and withdrawn from the well. This may be very desirable if the well is to be thus kept shut in for many hours, for instance, or several days. The operating tool can however remain connected to the valve and can be used to cycle the valve between open and closed positions any number of times. Also, it should be noted that even after the operating tool has been pulled free of the test tool, the operating tool can be reinserted into the test tool and again cylce the valve. This can be repeated any number of times, as desired. It should be noted also that each time the operating tool is removed from the test tool, the test tool is left with its valve in the upper position.

In most cases, the valve would be closed in its upper position, however, the valve can be constructed so that it is either open or closed in its upper position. The preferred form of test tool for normal production flow testing generally would be closed in its upper position, however, if it is desired to build a test tool in which the valve is open when in its upper position, such tool can be provided and will be discussed hereinbelow with respect to FIGS. 8A–9C.

Referring now to FIGS. 2A–2F, it will be seen that the test tool 100 has been lowered into the well tubing 20 and through the landing nipple 35. The test tool 100 includes the lock mandrel 102, the valve 104, and the operating tool 200. Test tool 100 may also include the recording instrument 106. The test tool 100 is lowered into the well on an operating tool 108 attached to the lower end of a wireline tool string 110 which is supported on a conventional wire line (not shown).

The lock mandrel 102 is like that illustrated and described in U.S. Pat. No. 3,208,531, supra, and performs the same function in the same manner as is taught in that patent. The locking mandrel includes a mandrel member 112 to which is attached a cage 113 as by threads as at 113*a* and having slots or windows 113*b* therein in which locking keys 114 are carried for radial movement between the retracted, released position (shown) and an expanded, locking position shown in FIG. 6C. The lock mandrel 102 is provided with an expander sleeve 115 having a fishing neck 116 attached to the upper end thereof as by threads 115*a*, and when this fishing neck and expander sleeve are moved downwardly to lowermost position, the expander sleeve will move the locking keys 114 outwardly to their locking position. However, before the expander sleeve expands the keys, its enlarged lower end providing the cam surface 117 near its lower end will engage the key spring 118 and will force the central part of the spring outwardly and apply an outward bias to the locking keys 114 tending to move them outwardly.

The lock mandrel 102 is provided with a packing set 119 which is adapted to seal with the finished bore 35*b* in the landing nipple to prevent leakage therebetween.

One or more screws 120 are disposed in apertures in the mandrel 112 for a purpose which will be brought to light later. The lower end of the mandrel 112 is threaded as at 122 to receive the equalizing valve body 124, having an equalizing port 125 therein and an equalizing valve 126 which initially covers the equalizing port 125 while its seals 125*a* seal above and below the equalizing port, but which can be moved to a lower position uncovering the equalizing port to allow flow to take place therethrough for the purpose of equalizing pressures above and below the packing 119. This equalizing valve is operated by a prong attached to a pulling tool by which the lock mandrel is retrieved from the well at the end of the tests.

The lower end of the equalizing valve 124 is threaded as at 130 for attachment of the elongate tubular housing 132 of the valve 104. Seal ring 131 seals this connection. The elongate tubular housing 132 is provided with a plurality of lateral inlet ports 134, and the lower end of the housing is threaded as at 135 for attachment of the adapter 136 which effectively seals the lower end of the elongate tubular housing 132. This connection also is sealed by a seal ring 131. The adapter 136 is threaded as at 137 to provide means for attachment of a recording instrument such as instrument 106 as shown.

Figure 2A:
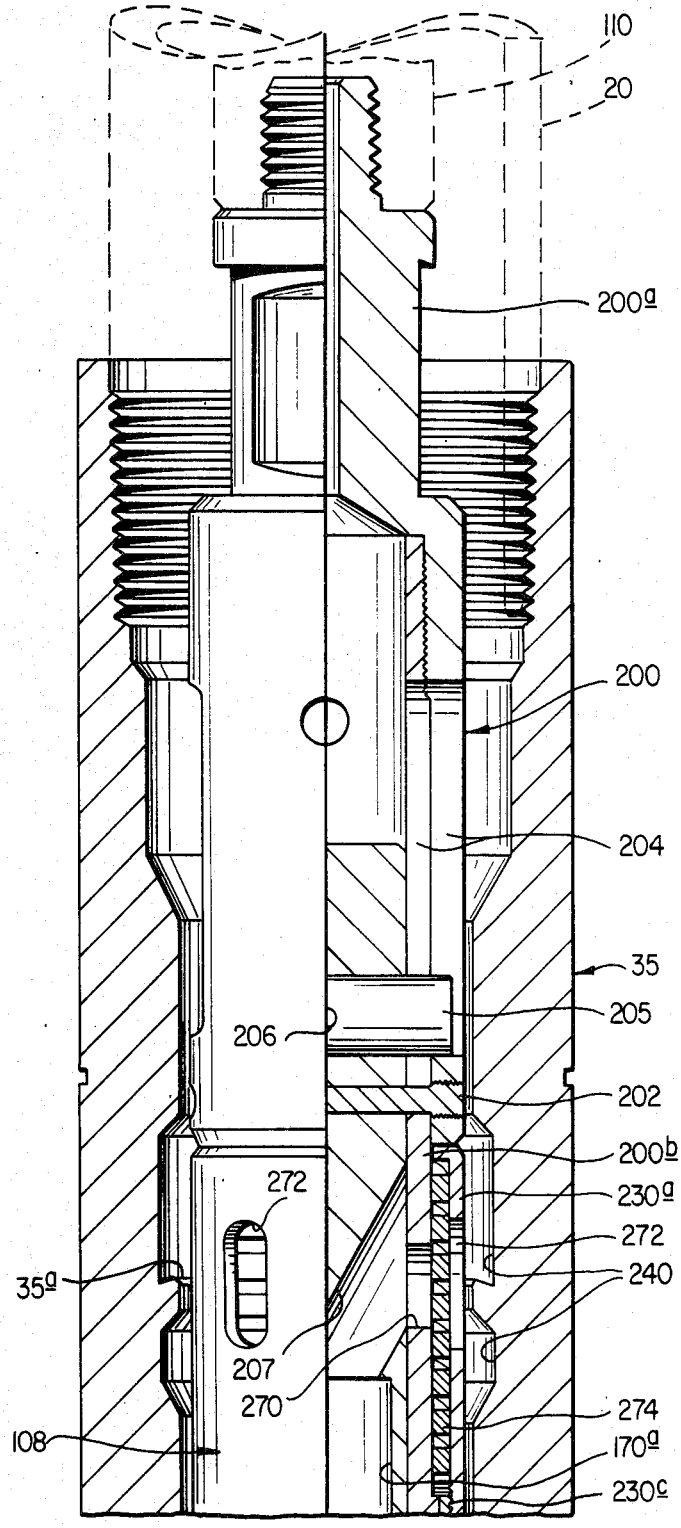
FIGS. 2A–2F, taken together, constitute a longitudinal view, partly in section and partly in elevation with some parts broken away, showing the test tool of the present invention as it is being lowered into the tubing of a well.
Figure 2C:
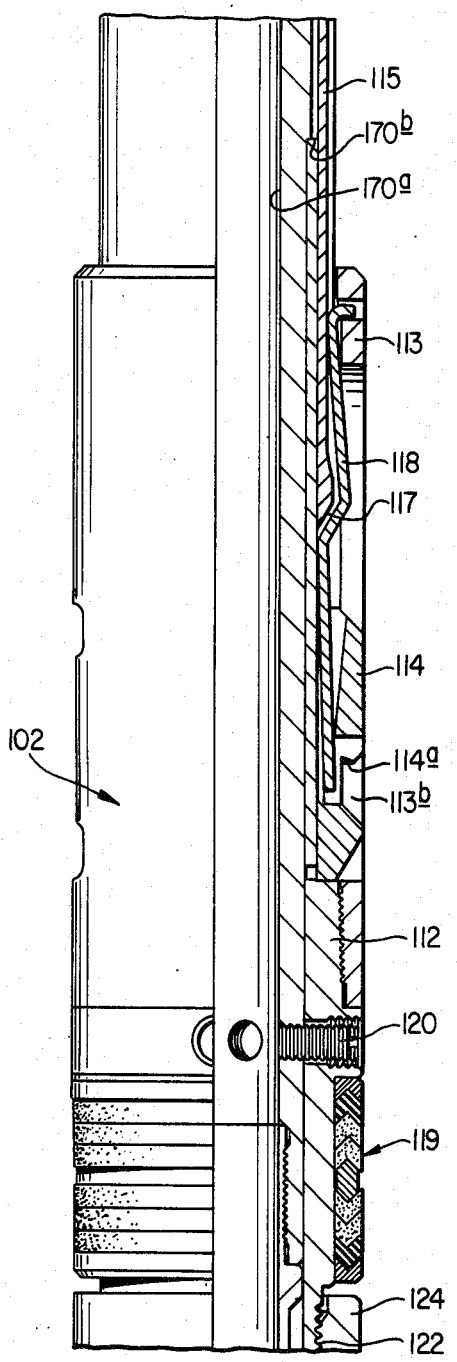
Figure 2B:
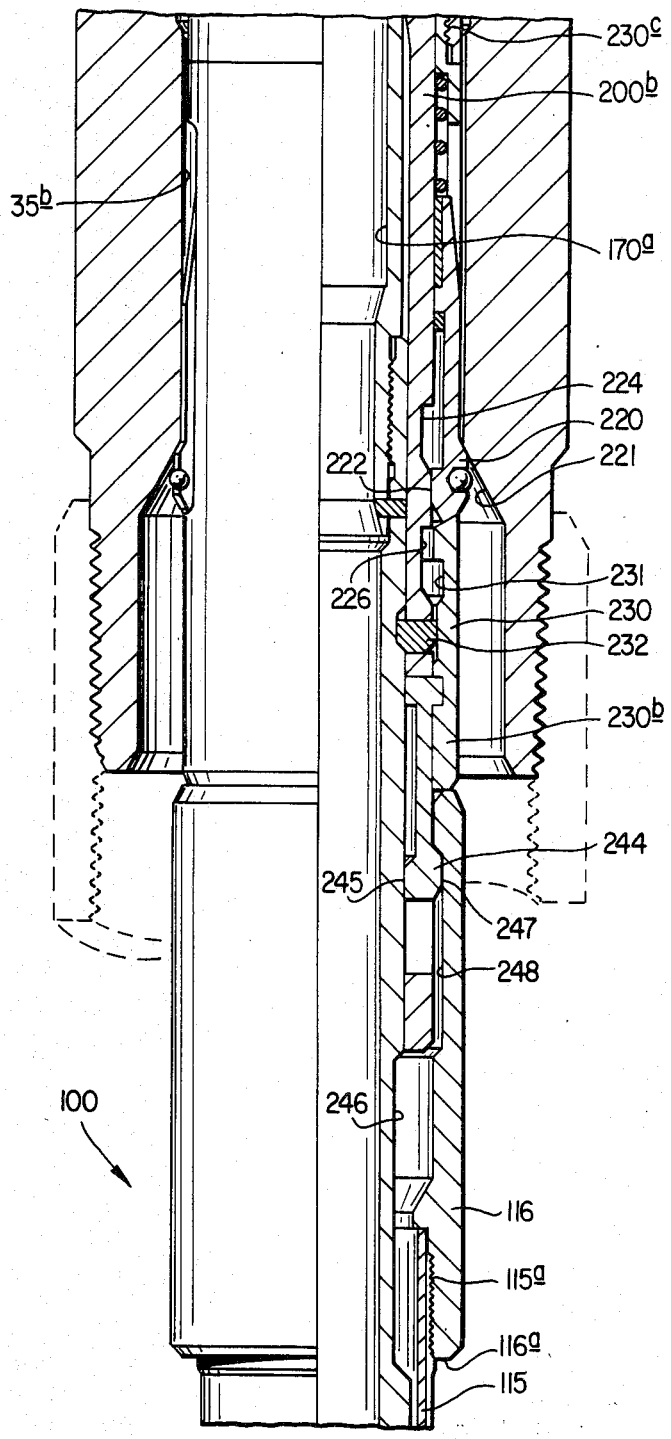
Figure 2D:
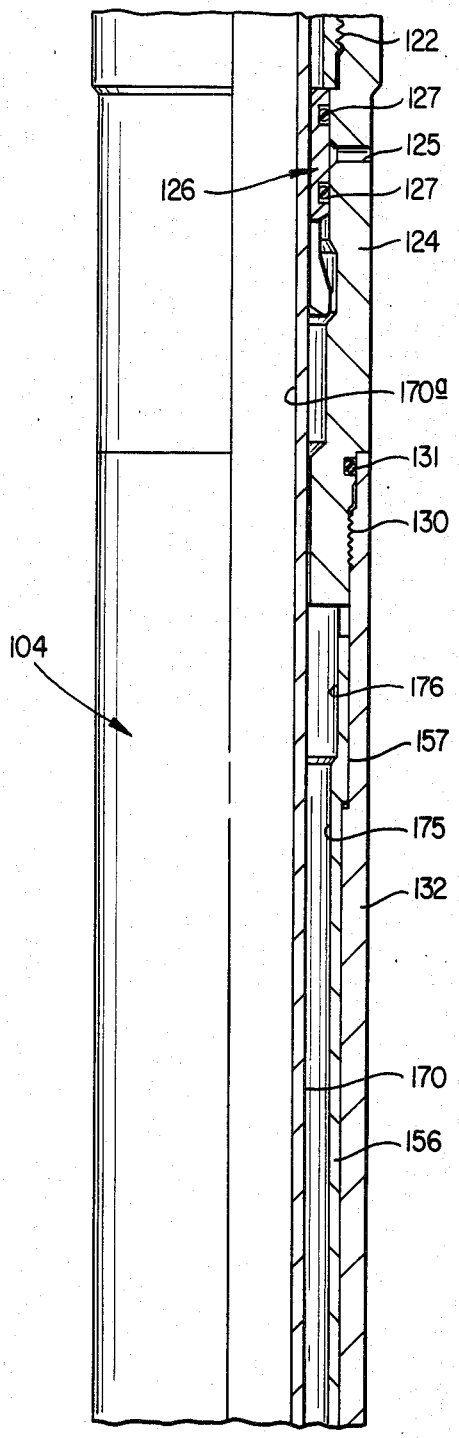
Figure 2E:
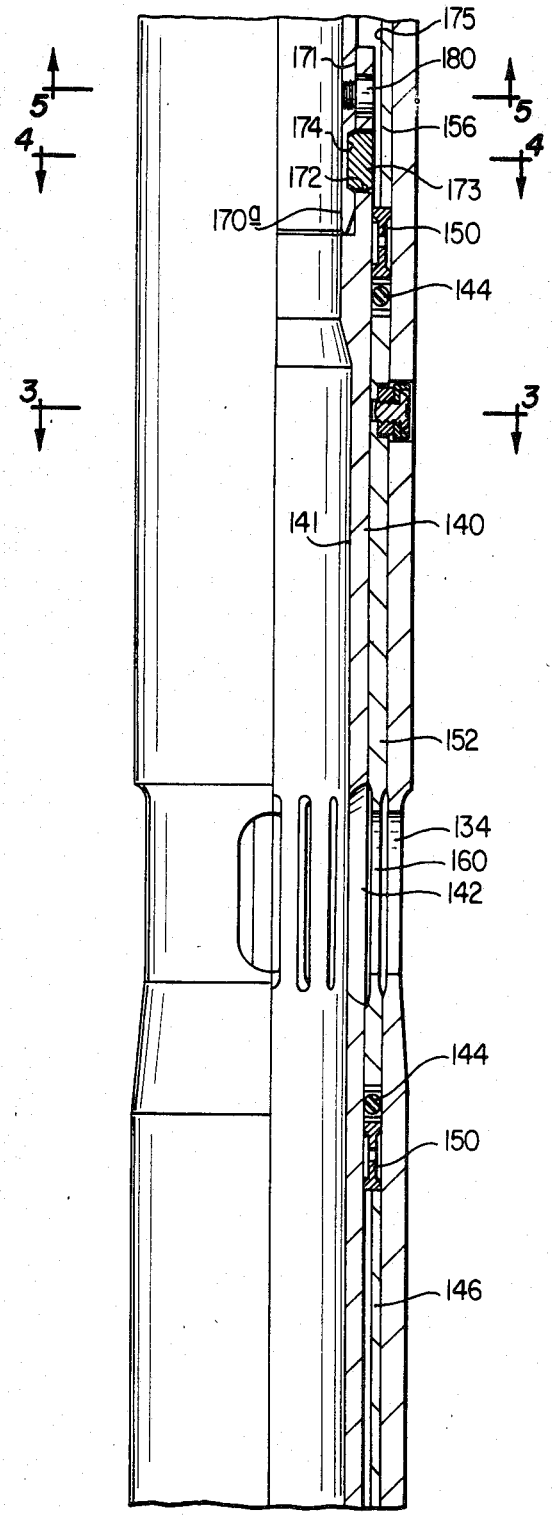
Figure 2F:
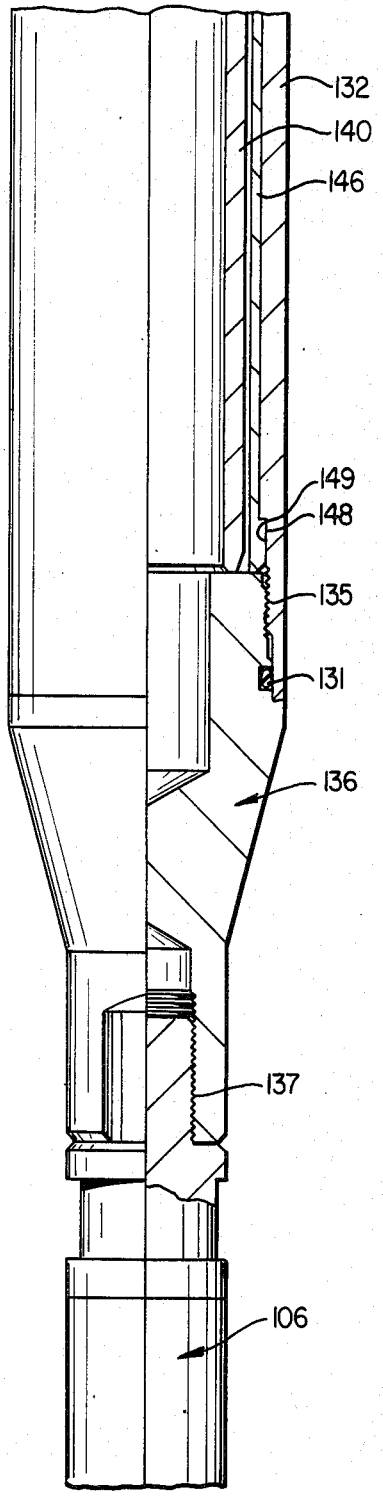

A sleeve valve 140 is slidably disposed within the elongate tubular housing 132 and has lateral flow ports 142 in its wall which align with the lateral inlet ports 134 of the tubular housing 132 when the sleeve valve 140 is in its lower position, shown in FIG. 2E. In this position, the sleeve valve is in its lowermost position, being supported not necessarily on the upper end of the adapter 136 but by means to be explained later. A pair of seal means including resilient seal rings 144 seal between the elongate tubular housing 132 and the sleeve valve 140 both above and below the lateral inlet ports 134 of the tubular housing. These seal rings are placed in suitable internal annular recesses provided in the housing by spaces provided between adjacent seal tubes which are placed end to end in axial alignment with their ends spaced apart. Thus, the lower seal tube 146 rests upon the upper end of the adapter 136 and has an external annular flange 148 engaged in a suitable recess 149 formed in the housing 132 as shown. The seal ring 144 is placed on top of lower lantern ring 150 which is supported on the upper end of the lower seal tube 146, as shown. The intermediate seal tube 152 is disposed above the lower seal ring 144 as shown, and the upper seal ring 144 is disposed on top of this intermediate seal tube. Above upper seal ring 144 an upper lantern ring 150 is located and on top of this is disposed the upper seal tube. The upper seal tube 156 is enlarged at its upper end as at 157, and this enlargement is disposed in a suitable internal annular recess formed at the upper end of the elongate tubular housing 132 to anchor the upper seal tube in place as shown. Thus, the spaces between the ends of the seal tubes provides space for the seal rings 144 and their respective lantern rings 150. The lantern rings are provided with holes in their walls as shown so that pressures will be equalized in this area and forces resulting from these pressures will be properly distributed. It will be noted that the upper and lower seal tubes 156 and 146, respectively, are a very loose fit with the sliding sleeve valve 140 while the intermediate seal tube 152 is a rather close fit with the sleeve valve. The lantern rings 150 centralize and guide the sleeve valve 140.

It will be noted that the intermediate seal tube is provided with lateral passages 160 which are maintained in alignment and in orientation with the lateral inlet ports 134 at all times in a manner to be described later.

The sleeve valve 140 is movable from its lower position (shown) to an upper position wherein its lateral passages 142 are above the upper seal ring 144 and the inlet ports 134 of the housing are sealed off from communication therewith.

Assume that a producing formation is being tested and that flow is taking place from the exterior of the housing to the interior thereof through the aligned inlet ports 134, flow ports 160, and passages 142. If the sleeve valve 140 at this time is moved upwardly, there will come a time when the exposed portion of slots 142 relative to the inlet ports 134 is so small that the flow therethrough will be pinched. As the valve continues upwardly and the lower end of the ports 142 of the sleeve valve only very slightly overlap the upper ends of the slots 160 in the intermediate seal tube, this flow is pinched even more. Then, as the slots 142 move into the rather close fitting bore of the intermediate seal tube 152, the flow is further reduced to a minimum. At this time, the upper ends of the passages 142 have not yet reached the upper seal ring 144. Therefore, by the time the ports 142 reach the upper seal ring 144, the flow through the very small opening between the exterior of the sleeve valve and the close fitting inner wall of the intermediate seal tube, this flow will be rather severely restricted and the ports 142 can be moved across the seal ring 144 under conditions of a very small differential pressure thereacross and can be thus moved across the seal ring with very little damage thereto, if any.

In a similar manner, when the valve is moved back to open position, the passages 142 are moved across the seal ring 144 into a condition where there can be very little flow due to the close fitting intermediate seal tube 152 around the sleeve valve. Then, well after the seal ring has been passed by the passages 142, these ports begin to communicate more directly with the inlet ports 134 of the elongate tubular housing 132. Thus the valve can be opened under conditions of very little flow, and the seal ring will suffer very little, if any.

It should be noticed that the seal rings 144 seal areas which are equal in size, thus providing a balance of forces on the sleeve valve 140 so that it will be rather easy to move from one position to another even though the differential pressure thereacross may be considerable.

The sleeve valve 140 is moved up and down in the elongate tubular housing 132 by an operator tube 170 having a longitudinal flow passage **170*a* therein and having its midsection secured to the lock mandrel 102 by the screws 120, as shown, and the operator tube 170 thus holds the sleeve valve 140** in the lower open position as shown. The sleeve valve being thus held in open position provides a generous flow course through the test tool during the running operation.

The operator tube 170 is provided with a downwardly facing shoulder **170*b* which is engageable with the extreme upper end of the lock mandrel 112 to limit downward movement relative thereto. Since the sleeve valve 140 is supported by the operator tube 170 which is supported against the upper end of the lock mandrel, the lower end of the sleeve valve may not contact the upper end of adapter 136**.

Figure 5:
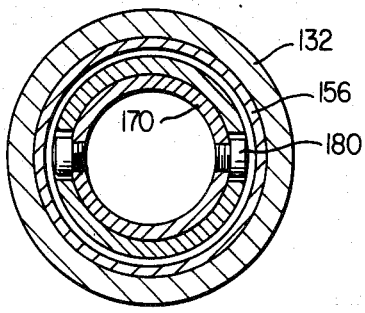
FIG. 5 is a cross-sectional view taken along line 5—5 of FIG. 2E.
Figure 4:
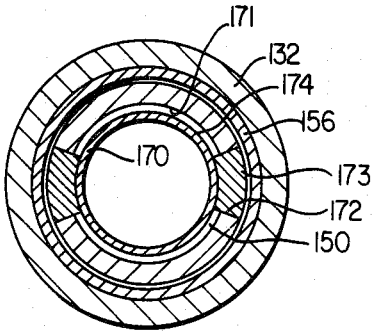
FIG. 4 is a cross-sectional view taken along line 4—4 of FIG. 2E.

The upper end of the sleeve valve is formed with a counterbore 171 providing a relatively thin wall in which a pair of windows 172 are formed and in which are disposed a pair of lugs 173 as shown. These lugs 173 are confined to their inner position by the wall of bore 175 of the upper seal tube 156 (see FIG. 2E), in which position they project into an external annular recess 174 formed in the exterior of the operator tube 170 (see FIG. 4) just a short distance above its lower end as shown. Thus, when the operator tube is moved upwardly, this upward force is transmitted through the lugs 173 to the sleeve valve 140 to move it upwardly. When the sleeve valve 140 is moved upwardly and approaches its uppermost position, the lugs 173 become aligned with internal annular recess 176 formed by the enlargement of the bore 175 of the upper seal tube. The lugs 173 can then move outwardly and disengage the recess 174 of the operator tube. This, in the absence of screws 180, effectively disconnects the operator tube from the sleeve valve and would allow the operator tube to be removed from the tool leaving the sleeve valve in closed position. However, in many cases, the operator tube will be further connected to the sleeve valve by one or more screws, such as the screw 180, which is threaded into a small threaded aperture in the operator tube and has its head exposed in a hole near the upper end of the sleeve valve this hole being somewhat larger than the head of the screw (see FIG. 5). Thus, as long as the lugs 173 are effective to connect the tube to the sleeve valve, the forces applied to the sleeve valve to move it up and down will be transmitted through the lugs, however, when the sleeve valve reaches its uppermost position and the lugs are opposite the recess 176 of the upper seal tube, the lugs are no longer effective to maintain such connection but such connection will still be maintained by the screws 180, the result being that when the sleeve valve 140 reaches its upmost position, the operator tube will be pulled upward no farther. Under these conditions, it is a simple matter to apply a downward force again to the operator tube to force the sleeve valve 140 back to its open or lower position. In this manner, the operator tube can be lifted or lowered to move the sleeve valve up and down any number of cycles so that the well can be allowed to flow or be kept shut in through as many cycles as desired to provide the information necessary for formation evaluation.

It is understood that in order to move the operator tube 170 up from the position shown in FIGS. 2A through 2D, the screws 120 must first be sheared. These screws 120 will be sheared only after the test tool has been properly set in locked and sealed condition in the landing nipple 35.

The operator tube is not only secured to the lock mandrel by screws 120 but also its upper end is secured to the body 200 of the operating tool 108 by shearable means such as the shear pin 202.

The body 200 telescopes over the upper end of the operator tube 170 and comprises two parts, which are an upper sub **200*a* and the main body member 200*b*. The upper sub 200*a* is screwed onto the upper end of the main body member 200*b* as shown, and the shear pin just mentioned passes through both of these members as well as through the operator tube as shown. In addition, the body members are slotted as at 204 to receive the ends of a transverse key or pin 205 which passes through a suitable aperture in the operator tube near its upper end and is secured in place therein by a cross-pin 206 as shown. The shear pin 202 prevents relative longitudinal movement between the operator tube and the housing initially, but after the pin is sheared, the operator tube can be moved relative to the housing or vice versa as permitted by the key 205 sliding in the slot 204**.

It will be noticed that the operator tube is tubular from its lower end to a point near its upper end and that the flow passage provided **170*a* by this tube is diverted outwardly to the right-hand side, as shown in FIG. 2A, by a slanted bore 207. When the housing 200 is in its lowermost position relative to the operator tube and the key 205 is at the upper end of the slot 204, the slanted bore 207 in the operator tube communicates directly with the slots 204** to form an outlet for fluids which would be flowing upwardly through the operator tube.

When the lock mandrel 102 is properly set in the landing nipple 35 downward jarring impacts are applied through the wire line tools to the upper end of the operating tool and these downward impacts will cause the shear pin 202 to become sheared to permit relative logitudinal movement between the operator tube and the housing of the operating tool. Downward movement of the operating tool then will force the expander sleeve 115 and its fishing neck 116 downwardly to force the locking keys 114 to their full outer positions of engagement with the recesses of the landing nipple 35, at which time the lower end 116*a* of the fishing neck 116 should rest on top of the cage 113 of the lock mandrel. The lock mandrel being now in locked and sealed condition in the landing nipple, and the sleeve valve being opened as shown in FIGS. 2A–2D, the well can be flowed through the aligned lateral ports of the valve mechanism, the flow being directed upwardly through the operator tube flow passage 170*a* to exit through the slanted bore 207 and slots 204 to be discharged into the tubing and continue upward to the surface.

To close the sleeve valve assembly the operator tube must be lifted. This may be done by lifting the operating tool but this can be done only after the screws 120 are sheared by upward jarring impacts. As soon as these screws become sheared the operating tool can be lifted, closing the sleeve valve 140. If the screws 180 which secure the operator tube to the sleeve valve 140 are not present, then as soon as the sleeve valve 140 reaches its uppermost position the lugs 173 will move outwardly into the recess 176 and the operator tube will be freed for withdrawal from the operating tool and from the well. If this stage is reached and it is decided to thereafter reopen the test tool the operating tool may be lowered again and the operator tube reinserted into the lock mandrel and moved down until its lower end again engages in the recess 171 in the upper end of the sleeve valve 140 and a downward force applied to move the sleeve down to open position. Of course, as soon as the sleeve valve 140 starts moving downwardly the lugs 173 will enter the tighter bore 175 of the upper seal tube and the lugs will be forced inwardly into engagement with the annular recess 174 on the operator tube to re-connect the operator tube with the sleeve valve 140. Thus, when it is again time to close the valve the sleeve valve 140 is lifted by lifting the operator tube and again when the sleeve 140 reaches its upper position the operator tube will be disconnected therefrom for withdrawal from the test tool and from the well.

If, on the other hand, the screws 180 are present, then when the sleeve valve 140 is moved to its upper position the lugs 173 will be in position for moving to release position but the screws 180 will remain intact so that the operator tube will be stopped with the sleeve valve 140 in the closed position. The sleeve valve and operator tube would be held in this position during a period in which the well would be shut in, and when it again became time to flow the well, the operator tube would be lowered to move the valve again to open position. In this manner the sleeve valve 140 can be moved up and down between open and closed positions as many times as desired. When the last cycle has ended and the operator tube is to be moved to its closed position for the last time, then when it reaches closed position upward jarring impacts are applied by the wireline tools to shear the screws 180 to disconnect the operator tube from the sleeve valve 140 so that the operator tube and the operating tool can be removed from the well.

In FIGS. 2A–2F the tool string has been lifted until the locator dogs 220 have lodged against the downwardly facing inclined shoulder 221 at the lower end of the polished bore 35*b* of the landing nipple 35. The locator dogs 220 are shown in their normal position as they would be when the tools are being lowered in the well. As the tools are being lowered into the well the locator dogs encounter the upper end of the nipple bore on the way down and the downward movement of the tool in the nipple forces the locator dogs upwardly relative to the main body 200*b*. The internal boss 222 at the lower end of the locator dogs are able to move into the external annular recess 224 on the main body 200*b* to thus retract the locator dogs to permit lowering of the tool through the landing nipple 35. The tool string may thus be lowered through any number of landing nipples such as landing nipple 35 or similar landing nipples.

When, however, it is desired to install the test tool in a landing nipple it is first lowered therethrough then lifted until the locator dogs lodge against the lower end of the landing nipple 35 as shown in FIG. 2B. When the condition shown obtains, further lifting of the tool string causes the main body 200*b* to be lifted relative to the locator dogs until the internal bosses 222 of the dogs retract into the external annular recess 226 which permits the tool string to be lifted through the landing nipple. As the locator dogs thus move downwardly relative to the body 200*b* the dogs force the cage 230 downward therewith until its internal annular recess 231 becomes aligned with the lugs 232. Cage 230 comprises upper and lower members 230*a* and 230*b* which are connected by thread 230*c*.

Also, this downward movement causes the lower end of the cage 230 to push the fishing neck 116 and the expander sleeve 115 attached thereto down to a position in which cam 117 on the expander sleeve applies an outward bias to key spring 118 causing the locking keys 114 to be biased toward their outermost position. In this condition the tool string is lifted up through the landing nipple 35. The locking keys 114 at this time are spring pressed outwardly, and will drag against the wall of the pipe when moving up or down relative thereto. The tool string is now stopped and lowered again into the landing nipple. This time the keys are spring pressed outwardly, and when the keys enter the tight bore of the landing nipple they will be forced inwardly considerably. Then, when they become aligned with the locking recesses, they will spring outwardly and engage therein. The downwardly facing shoulder 114*a* on the keys will come to rest against a corresponding upwardly facing abrupt shoulder 35*a* in the landing nipple and descent of the tool string will be stopped. At this time the lock mandrel is located in the landing nipple, the locking keys thereof are engaged in the locking recesses 240, and the packing set 119 is sealingly engaged in the polished bore 35*b* of the landing nipple. The engagement of the abrupt shoulders of the keys with the abrupt shoulders of the landing nipple precludes downward movement of the lock mandrel in the landing nipple, so downward jarring impacts are applied to shear the shear pin 202 which will permit the body 200 of the operating tool to move downwardly relative to the operating tool and lock mandrel in the landing nipple. As the main body 200 of the operating tool moves downwardly, the lower end of cage 230 thereon will force the fishing neck 116 and therefore the expander sleeve 117 to their lowermost position in which position the expander sleeve maintains the locking keys 114 in their expanded locking position. When the fishing neck 116 nears its lowermost position in which it abuts the upper end of the cage 113 of the locking mandrel, the retainer dogs 244 have moved down sufficiently relative to the operator tube to permit their inwardly projecting bosses 245 to enter the external annular recess 246 of the operator tube, thus permitting their external annular bosses 247 to disengage the fishing neck recess 248. This action disconnects the operating tool from the expander sleeve and fishing neck of the lock mandrel.

At this time the operating tool is still connected to the lock mandrel because the operator tube is pinned to the lock manrel by the screws 120. Since the lock mandrel is now securely locked in the landing nipple, upward jarring impacts may be applied to the operating tool and through it to the operator tube to shear the screws 120, after which the operator tube may be lifted to move the sleeve valve 140 to closed position as before explained. It should be remembered however that when the test tool is set in the landing nipple, it may be desired to flow the well for a period before the sleeve valve is moved to its upper or closed position.

Figure 3:
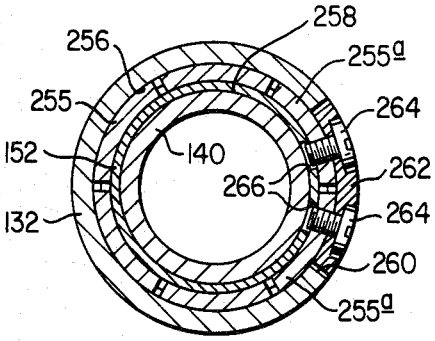
FIG. 3 is a cross-sectional view taken along line 3—3 of FIG. 2E.
Figure 6A:
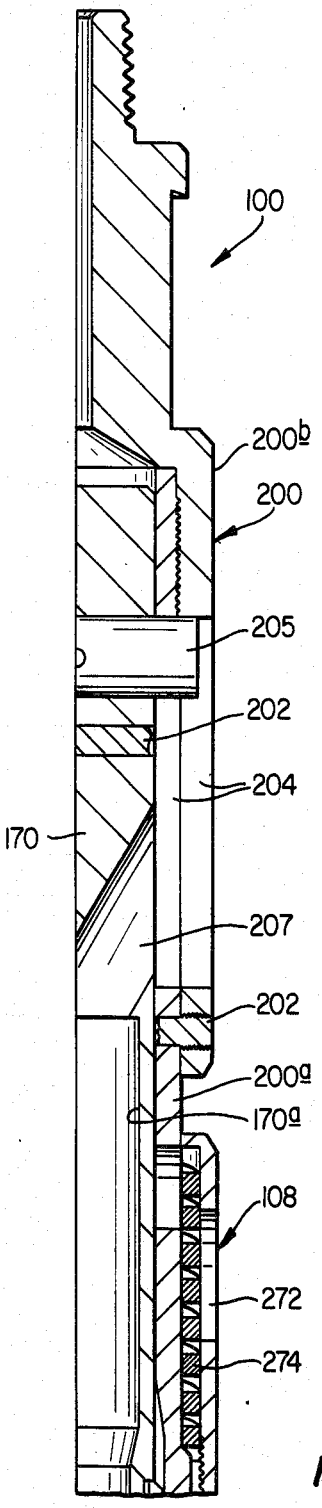
FIGS. 6A–6F, taken together, constitute a longitudinal half-sectional view showing only the right-hand half of the test tool of FIGS. 2A–2F installed in a landing nipple of a well and with its sleeve valve in open position and the operating tool still connected thereto.
Figure 6B:
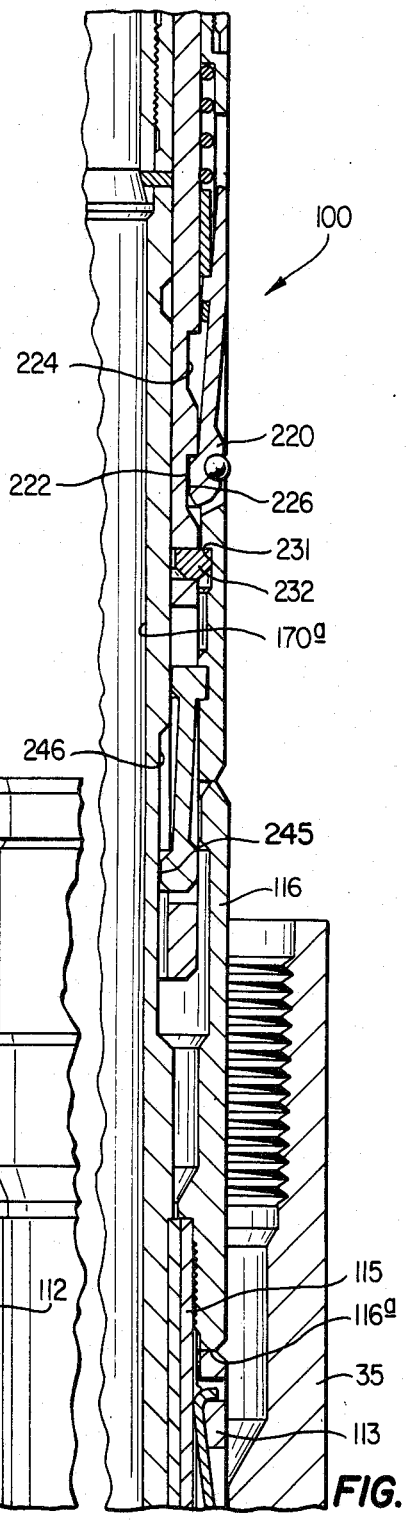

Referring now to FIG. 3, it will be seen in this cross sectional view that the intermediate seal tube 152 is anchored to the elongate tubular housing 132 by a plurality of lock segments 255 which are disposed in aligned annular recesses as shown. Thus the lugs 255 occupy both the internal annular recess 256 formed in the inner wall of the tubular housing 132 and also the external annular recess 258 formed in the exterior surface of the intermediate seal tube 152. These segments 255 thus anchor the intermediate seal tube in the tubular housing 132 against longitudinal displacement therein. The intermediate seal tube is also anchored against rotational displacement in the elongate tubular housing 132 in a manner now to be described.

The elongate tubular housing 132 is provided with a window 260 through which the segments 255 are inserted into the aligned recesses 256 and 258 as just described, and this window is then filled with a filler piece 262 held in place by a pair of screws which are screwed into threaded apertures in a pair of lugs 255*a* and these screws have their inner ends projecting into suitable apertures in the wall of the intermediate seal tube. In this manner the intermediate seal tube is anchored against the rotational movement in the housing. The holes 266 in which the inner ends of the screws engaged are formed in the intermediate seal tube in proper relation to the lateral flow ports 160 to assure that, when the intermediate seal tube is installed and the screws are set in place as shown in FIG. 3, the slots 160 in the intermediate seal tube will be in register with the inlet ports 134 of the elongate tubular housing 132. It will be seen in FIGS. 2A–2F that, as the test tool is being lowered into the well tubing, generous bypass passage is provided through the test tool thus permitting the tool to be lowered readily through fluid. The sleeve valve 140 is in its open position providing a large entrance area, the bore of the operating tube is open until at its upper end one or more slanted bores such as slanted bore 207 are provided whose upper ends communicate with lateral apertures 270 formed in the wall of main body member 200*b* and with the elongate windows 272 formed in the cage 230 as shown, there being ample flow passage between the coils of spring 274 to permit adequate bypass passage for the test tool. Of course, when the test tool is in operation and the sleeve valve is in open position for flowing of the well, the slanted bore at the upper end of the operator tube, as was before explained, communicates directly with the generous slots 204 in the main body 200*b* and its mating sub 200*a* so that bypassing the fluids should be no problem as this test tool is run into the well.

Referring now to FIGS. 6A–6F, it will be seen that the test tool 100 is installed in the landing nipple 35, that the keys 114 of the locking mandrel 102 are engaged in the locking recesses of the landing nipple, that the packing set 119 is sealingly engaged in the honed bore 35*a* of the landing nipple. Thus the lock mandrel is locked and sealed in the landing nipple 35. The sleeve valve 140 is in its lower open position wherein the inlet ports 134 of the elongate tubular housing 132 are aligned with both the lateral passage 160 of the intermediate seal tube and also the lateral ports 142 of the sleeve valve 140 so that flow may take place through the test tool. Such flow may pass upwardly through the bore 141 of the sleeve valve 140, through the operator tube 170, and through the slanted bore 207 at the upper end thereof, and exit through the slots 204 in the body 200 of the operating tool.

Figure 7A:
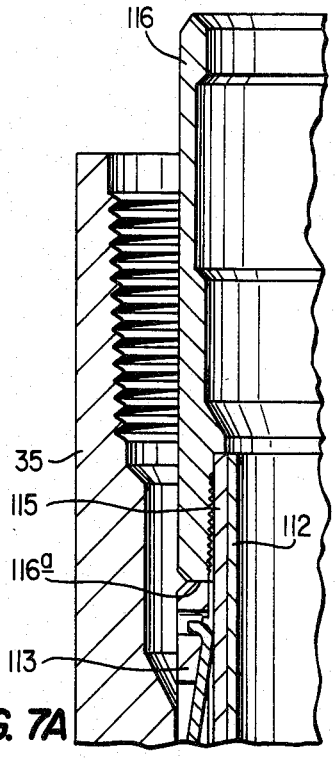
FIGS. 7A–7E, taken together, constitute a longitudinal half-sectional view showing only the left-hand half of the test tool of FIGS. 6A–6F but with the sleeve valve closed and the operating tool removed.
Figures 6D, 7C:
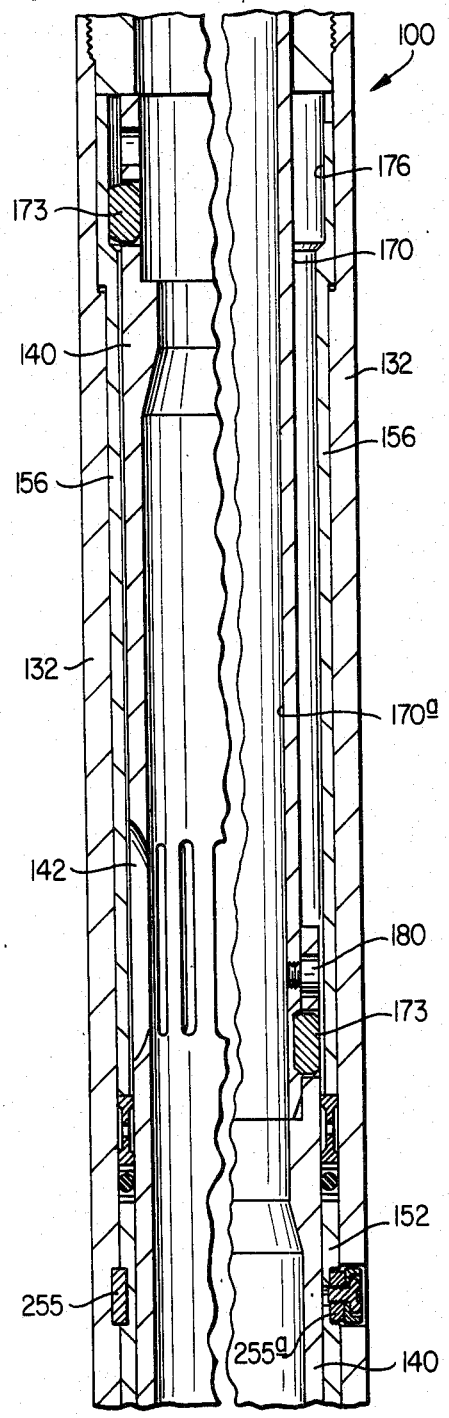
Figures 6C, 7B:
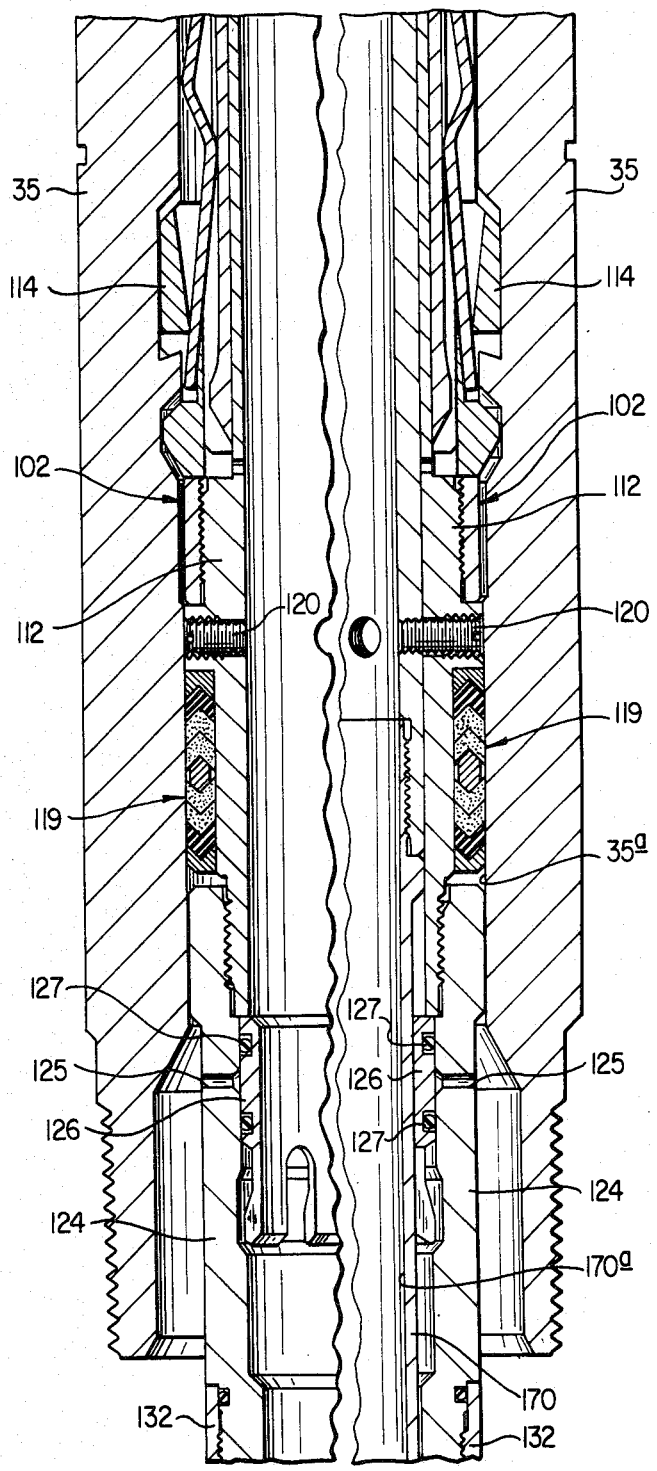
Figures 6E, 7D:
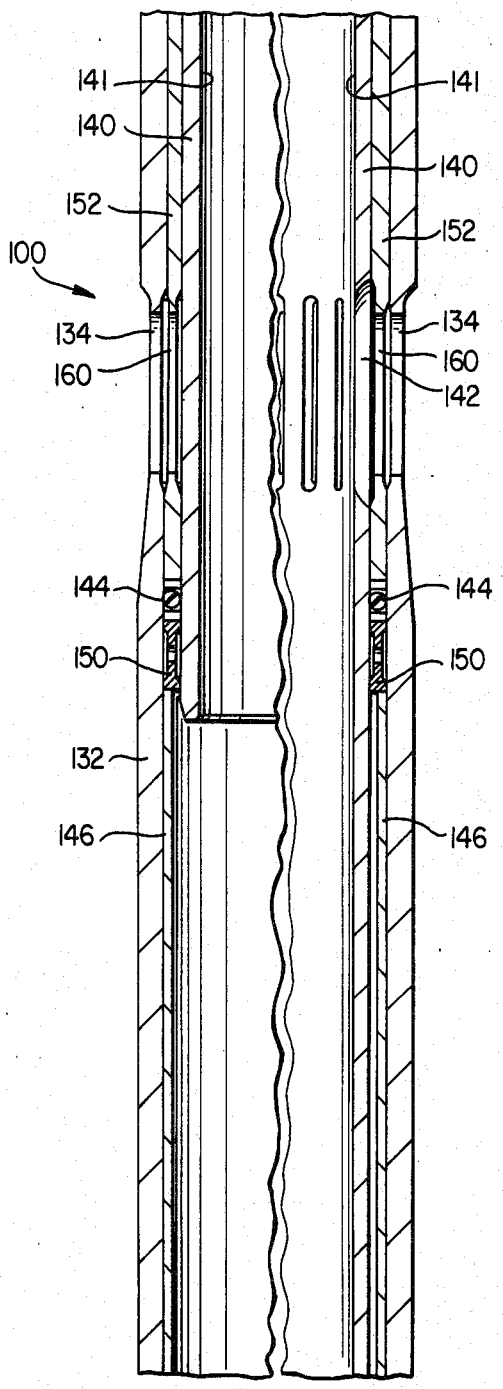
Figures 6F, 7E:
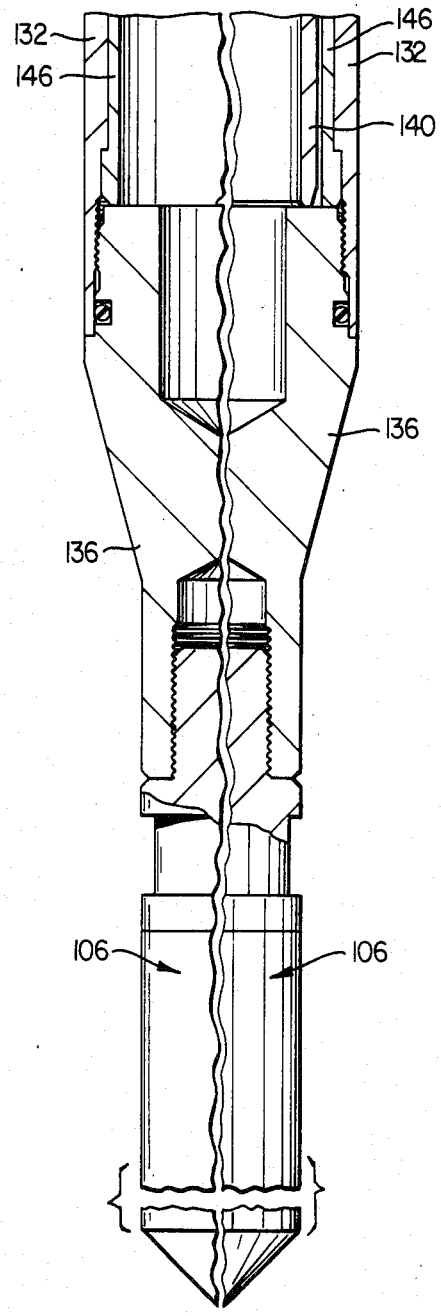

Before the sleeve valve 140 can be moved to closed position the screws 120, which in FIG. 6C clearly secure the operator tube against longitudinal movement relatively to the lock mandrel, must be sheared, and this is done by applying upward jarring impacts to the operator tube through the operating tool, as before explained. When the shear screws 120 are sheared, lifting of the operating tool will lift the operator tube and the sleeve valve 140 to the upper position. When the sleeve valve 140 reaches its upper position, the lugs 173 will be aligned with internal recess 176 in the upper seal tube and the lugs will be no longer effective to take such lifting load, however, since the screws 180 are yet intact, these screws will be effective in preventing a disconnect between the operator tube and the sleeve valve 140, thus permitting the cycling of the sleeve valve 140 with facility. When the last such cycle has been completed and it is desired to remove the tool from the well, the sleeve valve 140 is moved to its closed position after which upper jarring impacts are applied thereto through the operating tool to shear the screws 180 to disconnect the operator tube from the sleeve valve 140, after which the operating tool and wireline tools may be removed from the well. The test tool will now appear as seen in FIGS. 7A–7E.

To remove the lock mandrel and the valve, and instrument attached thereto, from the well, the operating tool is removed from the wireline tools and replaced by a suitable pulling tool such as the Otis Type GS pulling tool which is available from Otis Engineering Corporation, Dallas, Tex. This Type GS pulling tool must be equipped with a suitable prong which, when the pulling tool is lowered into the well and engaged with the fishing neck 116 of the locking mandrel, the prong will be in position to move the equalizing valve 126 downwardly to a position (not shown) wherein the equalizing ports 125 in the equalizing sub 124 are no longer straddled by the pair of seal rings 127 thus allowing any differential pressure across the closed valve to equalize through the equalizing ports 125. When such equalization of pressure is obtained, upward jarring impacts are applied to the fishing neck of the locking mandrel to lift the expander sleeve from engagement with the keys 114 and permit them to retract as the locking mandrel is jarred upwardly out of the landing nipple for retrieval from the well.

After the test tool is removed from the well, the chart or recording made by the instrument 106 is taken therefrom. This recording contains much of the test data which are used in evaluating and defining the producing reservoir.

It may now be seen that several test systems have been provided in which the test tool of the present invention is used. The first system involves a simple well having a string of well tubing 20 therein which is sealed about its upper end as at 24 at the surface, this tubing string having incorporated therein as a part thereof a suitable landing receptacle such as landing nipple 35 or 36 in which the test tool of this invention can be installed in locked and sealed relation therewith, this landing receptacle being as close to the selected formation as possible, the test tool in this case having a locking mandrel for locking and sealing in the landing receptacle and having a sliding sleeve valve attached to its lower end, the sliding sleeve valve mechanism being plugged at its lower end and having means thereon for suspending a recording instrument therebelow, the locking mandrel being run into the well on an operating tool attached thereto and having an operator tube as a part thereof which is attached or releasably connected to the upper end of the sliding sleeve valve so that, after the locking mandrel is set in the landing receptacle, the well can be flowed through the open valve, after which the valve can be closed merely by lifting the operating tool to move the valve to closed position, after which the operating tool can be lifted from the well and replaced by a retrieving tool by which the locking mandrel and test tool will be unlocked and retrieved from the well.

Such well could then be tested by allowing it to flow and the drawdown in the bottom hole pressure recorded by the instrument. The sleeve valve could then be closed to allow the well pressure to build up therebelow, this buildup in pressure also being recorded by the same recording instrument. After the test, the test tool would be retrieved and the recording taken from the instrument.

In a similar system the test tool would be equipped with shear screws (such as shear screws 180) which would allow the sleeve valve to be moved between open and closed position through multiple cycles (as many as desired) without the nuisence of having to reinsert the operator tube each cycle.

In another system, the landing receptacle would have a no-go shoulder facing upwardly which would be engaged by a corresponding downwardly facing no-go shoulder on the lock mandrel to positively limit downward movement of the test tool relative to the landing receptacle.

In another system the well tubing or flow conductor would be provided with a plurality of landing receptacles and, if desired, the lower one of these could be provided with an upwardly facing no-go shoulder.

In a more sophisticated system the well bore would be cased and there would be a packer sealing between the casing and the tubing near the bottom of the well and the landing receptacle in which the test tool would be set would be located below the packer. In this manner the test tool would be very near the formation to be tested and so would the packer so that the volume of the well to be pressurized when the tool is shut in would be minimized.

In most of these systems the test tool would be arranged like that shown in the FIGS. 2A–7E wherein the sleeve valve is in its open position when it is in its lower position and it must be moved upward to its closed position. Such test tool is useful not only in testing producing wells as described hereinabove, but can also be used in testing injection wells. If the well of FIG. 1 is seen as a producing well, as it has been viewed until now, well fluids from the formation enter the well bore through the casing perforations and flow upwardly through the tubing to the surface. If, on the other hand, we view the well in FIG. 1 as an injection well, then fluids are forced from the surface, down the tubing, and through the perforations into the formation. In either case, production well or injection well, the test tool of FIGS. 2A–7F may be used to gather information for evaluating the formation. However, should a reverse-acting valve mechanism be desired in such a well test tool, the test tool can be provided with a valve such as that illustrated in FIGS. 8A–9C.

The test tool 100 has been described hereinabove as being provided with an X-type locking device almost identical to that illustrated and described in the previously mentioned U.S. Pat. No. 3,208,531. In many cases where this type of locking device is to be subjected to differential pressures which may act thereacross in either an upwardly or downwardly direction, a no-go landing nipple is available. This landing nipple is known as the Otis Type XN landing nipple and is available from Otis Engineering Corporation, Dallas, Tex.

The Type XN landing nipple has the features seen in the landing receptacle 36 of FIG. 1. The XN landing nipple is provided with an upwardly facing no-go shoulder (such as shoulder 52 in receptacle 36), and to assure that the downwardly acting load applied to the Type XN locking mandrel is transmitted to the landing nipple through the no-go shoulder, no abrupt upwardly facing shoulder is provided like that seen in the landing receptacle 35 (which is a representation of the Type X landing nipple). Instead of such abrupt upwardly facing shoulder, the corresponding shoulder in the Type XN landing nipple is inclined upwardly and outwardly at substantially 45 degrees. Then, the Type XN locking device is provided with locking keys such as locking keys 42 having a profile which corresponds to the locking recesses of the Type XN landing nipple. Thus, substantially all of the downward load applied through the Type XN locking device is transmitted to the landing nipple through the upwardly facing no-go shoulder, but it should be noted, however, that since the expander sleeve maintains the locking keys in their outer, locking position, the Type XN locking device will withstand a great upwardly acting load in exactly the same manner as in the case of the Type X locking device, such upwardly acting load being transmitted to the landing nipple through the lock shoulders which are inclined downwardly and outwardly.

It should be noticed that the locking mandrel of the test tool cannot be locked in the landing nipple until the cage 230 of the operating tool has been moved down so that lugs 232 are free to move outward to engage internal recess 231 in the cage, as before explained, thus freeing the body 200 of the operating tool for movement relative to the operator tube. When the locking mandrel is then inserted fully in the landing nipple, downward jarring impacts cause the shear pin 202 to shear, allowing the operating tool body 200 to be moved down, pushing the expander sleeve 115 to full key-locking position.

Of course, initial downward movement of the cage 230 to align its internal recess 231 with lugs 232 is normally accomplished by first lowering the operating tool through a landing nipple and afterwards lifting it therethrough to cause the locator dogs 220 to move down until their internal bosses 222 can engage in external annular recess 226 on body 200 and latch there. But, however, if the operating tool cannot be tripped in such manner because, for example, the well contains a single landing nipple which happens to be a Type XN and the operating tool cannot be lowered therethrough, the operating tool may be tripped manually before it is lowered into the well.

Of course, where there are Type X landing nipples above the Type XN landing nipple, the operating tool may be tripped by lifting it through either of the Type X landing nipples. After the operating tool has been tripped, the Type XN locking mandrel will pass downwardly through a Type X landing nipple without difficulty.

Referring now to FIGS. 8A–9C, it will be seen that a modified form of valve is shown and is indicated generally by the reference numeral 100*a*. This second embodiment of the invention is a reverse acting test tool which may be used in testing injection wells. This test tool has been modified by replacing the former elongate tubular housing 132 with a modified housing 132*a* and replacing the normal sleeve valve 140 with the modified sleeve valve 140*a*.

In the modified form of test tool 100*a*, the elongate tubular housing 132*a* has its lateral inlet ports 134*a* located a few inches higher than were the inlet ports 134 of housing 132. The intermediate seal tube 152 is the same as before, but has been inverted, as shown, to move its passages 160 a few inches higher and thus align with the lateral inlet ports in the modified tubular housing 132*a*. The upper seal tube 156, the lower seal tube 146, the lantern rings 150 and the seal rings 144 remain unchanged. The sleeve valve 140*a* is the same as sleeve valve 140, except that its lateral flow ports 142*a* are a few inches lower than in sleeve valve 140.

In addition, the window 260*a* of the elongate tubular housing 132*a* and the internal annular recess associated therewith are at a location a few inches lower than before to align with the recess 258 of the intermediate seal tube 152 so that this now inverted tube may be anchored in place by the lugs 255 as in the test tool 100*a*.

Figures 8A, 9A:
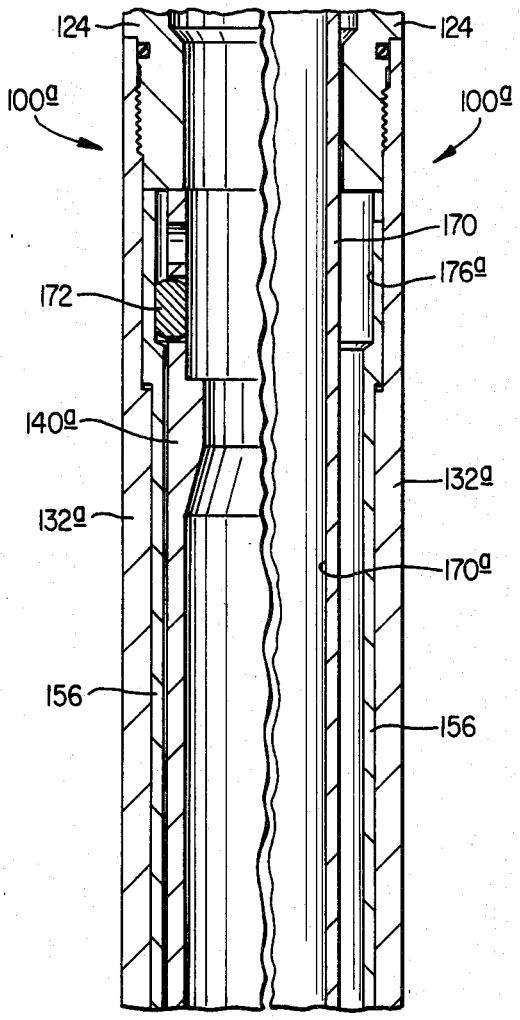
FIGS. 8A–8C, taken together, constitute a fragmentary longitudinal view similar to FIGS. 6D–6F showing only the right-hand half of a modified form of the invention with the sleeve valve thereof in its lower, closed position.
FIGS. 9A–9C taken together, constitute a fragmentary view similar to that of FIGS. 8A–8C, but showing only the left-hand half of the modified test tool with the sleeve valve in its upper, open position.
Figures 8B, 9B:
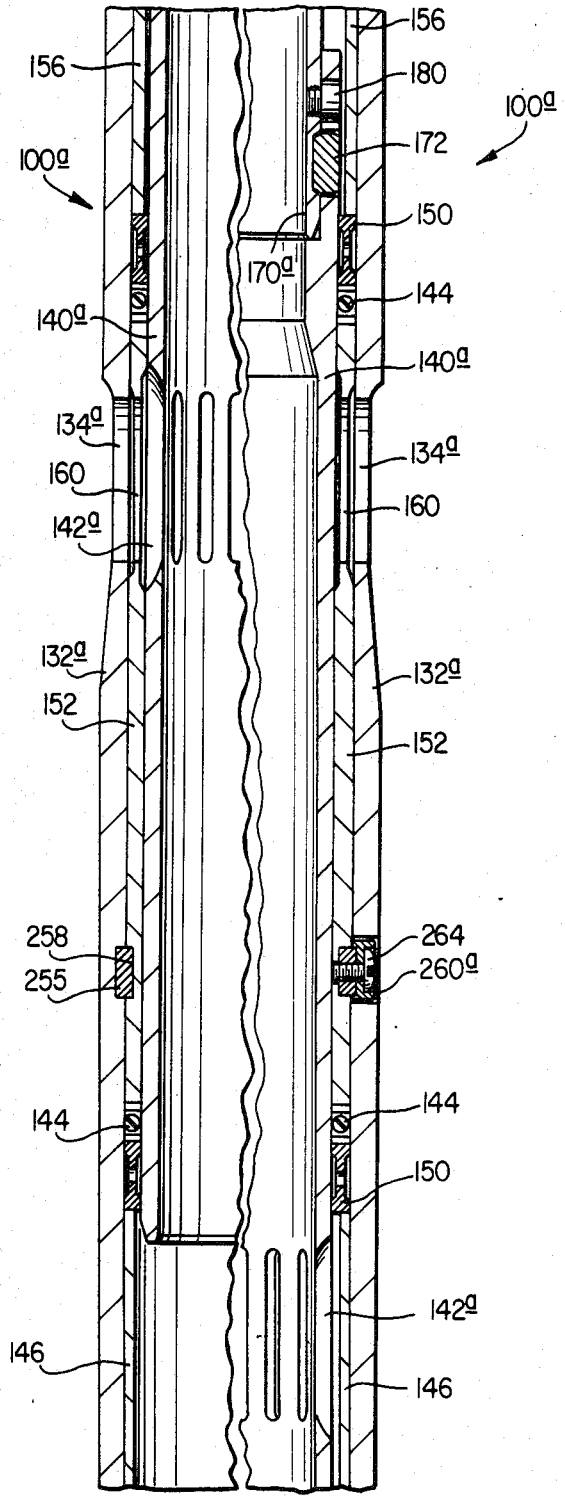
Figures 8C, 9C:
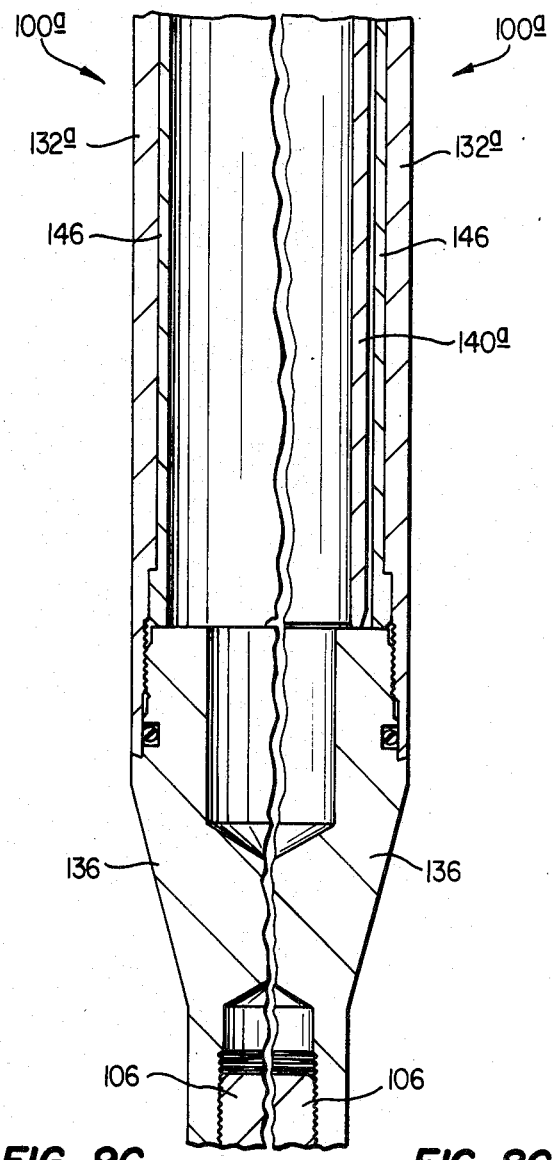

In FIGS. 8A–8C, the sleeve valve 140*a* is shown in its lower closed position. Its lateral flow ports 142*a* are disposed below the lower seal ring 144. Fluids injected downwardly through the test tool cannot reach and pass through the aligned openings 160 and 134*a* in the intermediate seal tube 152 and tubular housing 132*a*, respectively. When the sleeve valve 140*a* is in its upper position as seen in FIGS. 9A–9C, its lateral flow ports 142*a* are aligned with the inlet ports 160 and the passages 134*a* of the intermediate seal tube 152 and tubular housing 132*a*, and fluids injected downwardly through the test tool may exit through these aligned openings and flow through the well perforations into the formation.

When the sleeve valve 140*a* moves between open and closed positions, the close-fitting intermediate seal tube is effective to pinch the flow to a minimum as before explained so that the lower seal ring 144 will suffer little damage, if any, as a result of flow therepast as the lateral flow ports 142*a* move past the seal ring.

The modified test tool 100*a* functions exactly the same as test tool 100, except that the sleeve valve is moved up to open rather than down to open.

If desired the valve 104 could be formed so that it could be merely inverted without requiring modified parts in the process. For such conversion, the threaded connections and the adjacent recess on the opposite ends of the tubular housing would have to be identical. The lower end of the lower seal tube 146 would need to match the upper end of the upper seal tube 156. Then the sleeve valve would need its lower end formed to match its upper end. In addition, the sleeve valve would need lugs 173 in windows at both of its ends. When formed in such manner the entire valve mechanism could be disconnected from between the equalizing sub 124 and the adapter 136, turned end for end and re-connected to reverse the operation of the sleeve valve 140. In one instance it would be open when in its lower position, and in the other instance it would be closed when in its lower position.

It is to be noted that the pressures as stated before are balanced across the sliding sleeve valve so that the sleeve valve would easily be movable from one position to another regardless of which direction the differential pressure happened to be acting at the time. Since the pressures are balanced, the major force to be overcome is that of friction of the seal rings.

Should it be desired to perform flow tests such as those mentioned hereinabove in wells where the locking device of the test tool will be subjected to axial loads which may exceed the safe limit for the Type X or Type XN landing nipples and locking mandrels, there are available, also from Otis Engineering Corporation, similar landing nipples and locking devices which have a somewhat higher rating. These are the Type R and Type RN landing nipples and locking mandrels. Since these Type R and Type RN items posess a higher load rating, it is understandable that the bore through the locking mandrel is a little smaller in diameter than that in the Type X and Type XN locking mandrels. For this reason test tools and operating tools therefor such as those described in this application for patent should be designed for either the Type X and XN devices or the Type R and RN devices.

Thus it has been shown that the test tool illustrated and described hereinabove is well suited to carry out the operations described and thus fulfill the objects of the invention which have been set out hereinabove; that this test tool is usable in a variety of systems for gathering reservoir data for making evaluations thereof; that the present test tool is operable to perform such operations with but two trips into the well; and that the valve mechanism is relatively easy to manufacture and quite economical in addition. Further to this, since the seal rings which seal across the inlet ports and the valve mechanism are placed in recesses provided between the ends of the three axially aligned seal tubes, any one of these seal tubes is readily replaceable. Furthermore, the intermediate seal tube which fits rather closely around the sleeve valve pinches the flow as before explained before the openings thereof reach the seal ring which it must cross in order to close the valve. This of course minimizes damage or flow cutting of the seal ring during opening and closing of the valve.

The foregoing description and drawings of the invention are explanatory and illustrative only, and various changes in sizes, shapes, and arrangement of parts, as well as certain details of construction, may be made within the scope of the claims without departing from the true spirit of the invention.

I claim:

1. A well test tool installable in a landing receptacle in a well tubing string for controlling well flow at a downhole location during well testing procedures, said well test tool comprising:

a. a lock mandrel having lock means and sealing means thereon landable in said landing receptacle in sealed engagement therewith, said lock mandrel having an equalizing passage therein;

b. valve means suspended from said lock mandrel, said valve means including:

(i) an elongate tubular housing having its lower end closed and upper open end attached to said lock mandrel, said tubular housing having inlet port means intermediate its ends and means at its lower end for attachment of a recording instrument, (ii) sleeve valve closure means carried in said tubular housing and being slidable longitudinally between upper and lower positions for opening and closing said inlet port means to control flow therethrough, said sleeve valve closure means having means thereon for releasable connection of an operating tool thereto, and (iii) means sealing between said sleeve valve closure means and said elongate tubular housing both above and below said inlet port means; and c. operating tool means for installing and operating said lock mandrel and said sleeve valve, said operating tool including:

(i) an elongate tubular body closed at its upper end and having means at its top for attachment to a tool string and means at its lower end for releasable attachment to said lock mandrel, said releasable attachment means being automtically releasable in response to downward movement of said elongate tubular body relative to said lock mandrel, said elongate tubular body having outlet port means intermediate its ends, (ii) operating tube means having its upper end closed and telescoped into said elongate tubular body for sliding movement relative thereto and having flow ports near its upper end communicating at all times with said outlet port means in said elongate tubular body, said operating tube means extending through said lock mandrel and into said valve means therebelow and having means on its lower end engageable with said connection means on said sleeve valve means for releasably connecting said operating tube to said sleeve valve, closure means said connection being releasable automatically upon said sleeve valve means being moved to its upper position, (iii) means on said operating tube and on said elongate tubular body coengageable to limit relative longitudinal movement therebetween, and d. means on said operating tube means and on said lock mandrel coengageable to releasably secure them together against relative longitudinal movement therebetween, said securing means being releasable in response to upward movement to said operating tube means; relative to said lock mandrel e. whereby, after said lock mandrel has been installed in said landing receptacle and said elongate tubular body has been automatically released from said lock mandrel, further lifting of said elongate tubular body is utilized to apply an upward force to said operating tube means causing said securing means to release to permit said operating tube means to be lifted to move said sleeve valve closure means from its lower to its upper position, said means connecting said operating tube means to said sleeve valve automatically releasing when said sleeve valve reaches its upper position to allow said operating tool to lifted free of said lock mandrel for withdrawal from the well, leaving said sleeve valve in its upper position.

2. The well test tool of claim 1, wherein said means releasably connecting said operating tube means to said sleeve valve closure means includes:

a. lugs carried in windows of said sleeve valve closure means for radial movement therein between inner connecting and outer disconnecting positions, b. recess means on said operator tube for receiving said lugs in their connecting position, c. means in said elongate tubular housing confining said lugs in their inner connecting position, and d. recess means in said tubular housing for receiving said lugs when said sleeve valve closure means is moved to its upper position and said lugs move to their outer disconnecting position.

3. The well test tool of claim 2, wherein said lock mandrel is formed with an equalizing passage therein and has an equalizing valve for controlling fluid flow therethrough, and wherein said means for preventing relative longitudinal movement between said lock mandrel and said operator tube is at least one shearable member disposed in aligned apertures of said lock mandrel and said operator tube.

4. The well test tool of claim 3, wherein said operator tube and said elongate tubular body are provided with slot means on one and pin means on the other coengaged to limit relative longitudinal movement therebetween.

5. The well test tool of claim 4, wherein said means sealing between said elongate housing and said sleeve valve closure means includes:

a. internal recess means in said elongate tubular housing located above and below said inlet port means, said internal recesses being provided by (i) lower seal tube, (ii) intermediate seal tube, and (iii) upper seal tube, (iv) said lower, intermediate and upper seal tubes being disposed between the inner wall of said tubular housing and the outer wall of said sleeve valve closure means and being spaced from each other to provide an internal annular recess between said lower and intermediate tubes and between said intermediate and upper tubes, b. means anchoring each of said lower, intermediate, and upper seal tubes against longitudinal movement in said elongate tubular housing, and c. seal ring means in each of said internal annular recesses for sealing between said elongate tubular housing and the exterior of said sleeve valve closure means.

6. The well test tool of claim 5, wherein said sleeve valve closure means is provided with lateral flow passages intermediate its ends and said intermediate seal tube is a close sliding fit with said sleeve valve closure member and is of sufficient length to allow said lateral flow ports to pass said inlet ports of said elongate tubular housing before reaching the annular seal ring thereabove whereby flow entering said inlet ports of said elongate tubular housing and passing through said lateral flow passages of said sleeve valve closure means will be minimized as a result of being throttled by said close fitting intermediate seal tube to minimize damage to said upper annular seal ring as said lateral flow passages of said sleeve valve closure means move therepast.

7. The well test tool of claim 6, wherein shearable screws are disposed in aligned apertures of said sleeve valve closure means and said operator tube to maintain said operator tube connected when said sleeve closure means reaches its upper position to facilitate cycling said sleeve valve closure means between its upper and lower positions to provide repeated flow and shut-in periods for desired types of well tests, said shearable screws being shearable to release said operating tool from said sleeve valve means at the end of said tests.

8. The well test tool of claim 1, 2, 3, 4, 5, 6, or 7, wherein the lateral flow ports in said sleeve valve closure means are aligned with said inlet port means of said elongate tubular housing when said sleeve valve closure means is in its lower position.

9. The well test tool of claim 8, in combination with a landing nipple comprising a tubular body having means on at least one end thereof for attachment to a well tubing string and having (i) internal lock recess means therein engageable by said lock means on said lock mandrel for locking said lock mandrel in said landing nipple, and (ii) a smooth bore portion engageable by said seal means on said lock mandrel for sealing between said lock mandrel and said landing nipple.

10. The combination of well test tool and landing nipple of claim 9, wherein said lock mandrel is further provided with a downwardly facing no-go shoulder, and said landing nipple is provided with an internal upwardly facing no-go shoulder engageable by said downwardly facing no-go shoulder of said lock mandrel to positively limit downward movement of said lock mandrel in said landing nipple.

11. The well test tool of claim 1, 2, 3, 4, 5, 6, or 7, wherein the lateral flow ports in said sleeve valve closure means are aligned with said inlet port means of said elongate tubular housing when said sleeve valve closure means is in its upper position.

12. The well test tool of claim 11, in combination with a landing nipple comprising a tubular body having means on at least one end thereof for attachment to a well tubing string and having a. internal lock recess means therein engageable by said lock means on said lock mandrel for locking said lock mandrel in said landing nipple, and b. a smooth bore portion engageable by said seal means on said lock mandrel for sealing between said lock mandrel and said landing nipple.

13. The combination of well test tool and landing nipple of claim 12, wherein said lock mandrel is further provided with a downwardly facing no-go shoulder, and said landing nipple is provided with an internal upwardly facing no-go shoulder engageable by said downwardly facing no-go shoulder of said lock mandrel to positively limit downward movement of said lock mandrel in said landing nipple.

14. A system for testing a selected earth formation, comprising:

a. a well bore penetrating and communicating with said selected earth formation;

b. a flow conductor in said well bore and having its lower end in fluid communication with said selected earth formation, said flow conductor including receptacle means;

c. means sealing said well bore about said flow conductor at the surface;

d. valve means at the surface for controlling flow through said flow conductor; and e. test tool means removably locked and sealed in said receptacle means of said flow conductor, said test tool including:

f. a lock mandrel having lock means and seal means thereon locked and sealed in said receptacle means;

g. valve means supported on said lock mandrel and having sleeve valve member movable therein between upper and lower positions for controlling flow therethrough;

h. operating tool means for installing and operating said lock mandrel and valve means, said operating tool including:

(i) an elongate tubular body having means on its upper closed end for attachment to a tool string, outlet port means intermediate its ends, and means at its lower end for attachment to said lock mandrel, said attachment means being automatically releasable in response to downward movement of said elongate tubular body relative to said lock means of said lock mandrel, (ii) operating tube means having its closed upper end telescoped into said elongate tubular housing for relative sliding movement therewith and having flow ports near its upper end communicating with said outlet port means of said elongate tubular housing, said operating tube means extending through said lock mandrel and having its lower end releasably connected to said sleeve valve member for moving the same between its upper and lower positions, said connection being releasable automatically upon movement of said sleeve valve member to its upper position;

i. means on said operating tube means said elongate tubular housing coengageable to limit relative longitudinal movement therebetween; and j. means initially releasably securing said operating tube means to said lock mandrel, said securing means being releasable in response said operating tube means being moved upward relative to said lock mandrel, whereby after said securing means has been sheared, said sleeve valve member can be moved by movement of said operating tube between upper and lower positions to control flow through said test tool and flow conductor.

15. The system of claim 14, wherein said test tool means further includes shearable means disposed in aligned apertures of said sleeve valve member and said operating tube means to maintain said operating tube means connected to said sleeve valve member when said sleeve valve member reaches its upper position to facilitate cycling said sleeve valve member between its upper and lower positions to provide repeated flow and shut-in test periods as desired, said shearable means being shearable by upward forces applied to said operating tube means after said operating tube means has reached its upper position.

16. The system of claim 15, wherein said lock mandrel is further provided with a downwardly facing no-go shoulder, and said receptacle means is provided with an upwardly facing no-go shoulder engageable by said downwardly facing no-go shoulder of said lock mandrel to positively limit downward movement of said lock mandrel in said receptacle means.

17. The system of claim 16 wherein said flow conductor is provided with a plurality of receptacle means connected therein at spaced-apart locations.

18. The system of claim 17, wherein said well bore is lined with well casing, and a well packer seals between said casing and said flow conductor above the formation to be tested, and one of said plurality of receptacle means is located below said well packer.

19. The system of claim 14, 15, 16, 17, or 18, wherein said sleeve valve member permits flow through said valve means when said sleeve valve member is in its lower position.

20. The system of claim 14, 15, 16, 17, or 18, wherein said sleeve valve member permits flow through said valve means when said sleeve valve member is in its upper position.

* * * * *